US006529168B2

(12) United States Patent
Mikkola et al.

(10) Patent No.: US 6,529,168 B2
(45) Date of Patent: Mar. 4, 2003

(54) DOUBLE-ACTION ANTENNA

(75) Inventors: Jyrki Mikkola, Kempele (FI); Suvi Tarvas, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/039,515

(22) Filed: Oct. 23, 2001

(65) Prior Publication Data

US 2002/0084939 A1 Jul. 4, 2002

(30) Foreign Application Priority Data

Oct. 27, 2000 (FI) ..... 20002365

(51) Int. Cl.[7] ..... H01Q 1/24

(52) U.S. Cl. ..... 343/702; 343/700 MS; 343/866

(58) Field of Search ..... 343/700 MS, 702, 343/715, 741, 866

(56) References Cited

U.S. PATENT DOCUMENTS 6,137,445 A * 10/2000 Ha et al. ..... 343/702
6,225,951 B1 * 5/2001 Holshouser et al. . 343/700 MS
6,252,554 B1 * 6/2001 Isohatala et al. ..... 343/700 MS
6,380,903 B1 * 4/2002 Hayes et al. ..... 343/700 MS

FOREIGN PATENT DOCUMENTS

EP 523867 6/1992
WO WO 00/26987 10/1998

* cited by examiner

*Primary Examiner*—Tan Ho
(74) *Attorney, Agent, or Firm*—Darby & Darby

(57) ABSTRACT

The invention relates to double-action antenna structures. The structure comprises an antenna inside the covering of a mobile station, a switch (SW) and a whip, element (240) movable in relation to the former two. The internal antenna comprises two elements the first of which (220) is connected to the feed conductor (202) of the whole antenna structure and the second to the signal ground (203, 210). When the whip element is retracted, the said switch galvanically interconnects the elements of the internal antenna. Thus only the internal antenna functions and the whip has no practical significance. When the whip element is extended, its lower end disconnects, by means of the switch, the elements of the internal antenna, and the whip element itself is connected in series with the first element. Thus, a radiating element is provided by the series connection (240, 220) of the whip and the first element, and the shorted element (230) of the internal antenna has no practical significance. The first element further provides for the matching of the whip element. The antenna structure may have one or more operating bands. In the structure according to the invention the length of the whip element may be chosen relatively freely because the electrical length of the structure can always be made suitable by means of the internal antenna element connected in series with the whip element. No mechanical parts or components are needed for the matching of the whip element.

8 Claims, 4 Drawing Sheets

DOUBLE-ACTION ANTENNA

FIELD OF THE INVENTION

The invention relates in particular to double-action antenna structures suitable for mobile stations, in which structures one component is a retractable whip element.

BACKGROUND

In the field of portable radio equipment, mobile stations in particular, the manufacture of antennas has become very demanding. As new frequency bands are introduced, an antenna often has to function in two or more frequency bands. When the devices are small, the antenna, too, must be small; preferably it is placed inside the covering of the apparatus, thus avoiding an impractical protrusion. Understandably, however, the radiation characteristics of an internal antenna are somewhat poorer that those of an external antenna. Moreover, an internal antenna is more sensitive to the effect of the hand of the user, for example. These disadvantages can be reduced using a double-action antenna so that a movable antenna element belonging to the structure can be pulled partly out when necessary in order to improve the quality of the connection.

A retractable whip element is well known as such. If the antenna structure additionally comprises a second radiating element, it is usually an element outside the covering of the apparatus, considerably shorter than the whip element. Such a double-action antenna, which in one operating mode is located completely inside the covering of the apparatus, is disclosed in an earlier patent application F1991359 by the same applicant. The structure is depicted in FIG. 1. It comprises a ground plane 110, radiating planar element 120, feed conductor 102 and a short-circuit conductor 103, which constitute a PIFA (Planar Inverted F Antenna) type portion of the whole antenna, located inside the covering of the radio apparatus. The planar element 120 has a slot 125 in it, which is shaped such that the resonance frequency of the planar antenna is as desired. The structure further includes a whip element 130, at the lower end of which there is a connecting part 131. When the whip is in its lower position, it has no significant coupling with the PIFA parts. When the whip is in its upper position, the connecting part 131 is in galvanic contact with the planar element 120 on both sides of the slot 125 so that the slot becomes short-circuited. Short-circuiting the slot considerably increases the resonance frequency of the planar antenna, whereby the planar antenna will not function as an antenna in the operating frequency band when the whip is in the pulled-out position. The whip element is so dimensioned that it will function as a monopole antenna in the same operating frequency band, thereby replacing the internal planar antenna. The task of the planar element 120 is then to function as a part in the feed line of the whip and as an impedance-matching element of the whip. The PIFA may also be arranged so as to have two frequencies so that in its upper position the whip element changes e.g. the lower resonance frequency of the PIFA in such a manner that only the pulled-out whip functions as the radiating element at the lower operating frequency. Then the conductive plane of the PIFA functions as the radiating element at the upper operating frequency. Alternatively, the pulled-out whip element just enhances the operation of the antenna at the lower operating frequency without changing the resonance frequency of the PIFA.

BRIEF SUMMARY

It is an object of the invention to provide a double-action antenna in a novel and more advantageous manner than in known structures. The antenna structure according to the invention is characterized by what is specified in the independent claim 1. Some advantageous embodiments of the invention are presented in the dependent claims.

The basic idea of the invention is as follows: An antenna structure comprises an antenna located inside the covering of a mobile station, a switch and a whip element movable in relation to the former two. The internal antenna comprises two elements one of which is connected to the feed conductor of the whole antenna structure and the other to the signal ground through a short-circuit conductor. When the whip element is retracted, said switch galvanically connects the elements of the internal antenna to one another. Then, only the internal antenna is in use and the whip has no practical significance. When the whip element is pulled out, its lower end disconnects, by means of the switch, the elements of the internal antenna from one another, and the whip element itself is connected in series with that element at one end of which the feed conductor of the antenna structure is joined. Thus the series connection of the whip and the element in question functions as a radiator, and the shorted element of the internal antenna has no practical significance. In addition, the internal element of the series connection provides for the matching of the whip element.

An advantage of the invention is that in the structure according to the invention the length of the whip element can be chosen relatively freely. This is due to the fact that by means of the internal antenna element connected in series with the whip element the electrical length of the structure can be made e.g. a quarter of the wavelength or three quarters of the wavelength. Another advantage of the invention is, in accordance with the above, that no separate mechanical parts or components are needed for the matching of the whip element. A further advantage of the invention is that the structure according to the invention is relatively simple and inexpensive to manufacture.

BRIEF DESCRIPTION OF THE DRAWINGS

The invention is described in detail in the following. Reference is made to the accompanying drawings in which.

EMBODIMENTS OF THE INVENTION

Figure 1:
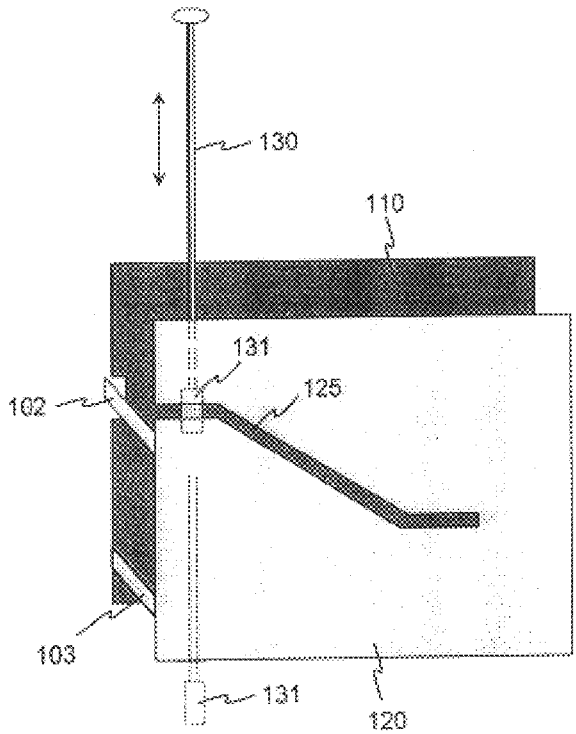
Fig. 1 PRIOR ART
FIG. 1 shows an example of an antenna structure according to the prior art.

FIG. 1 was already discussed in conjunction with the description of the prior art.

Figure 2:
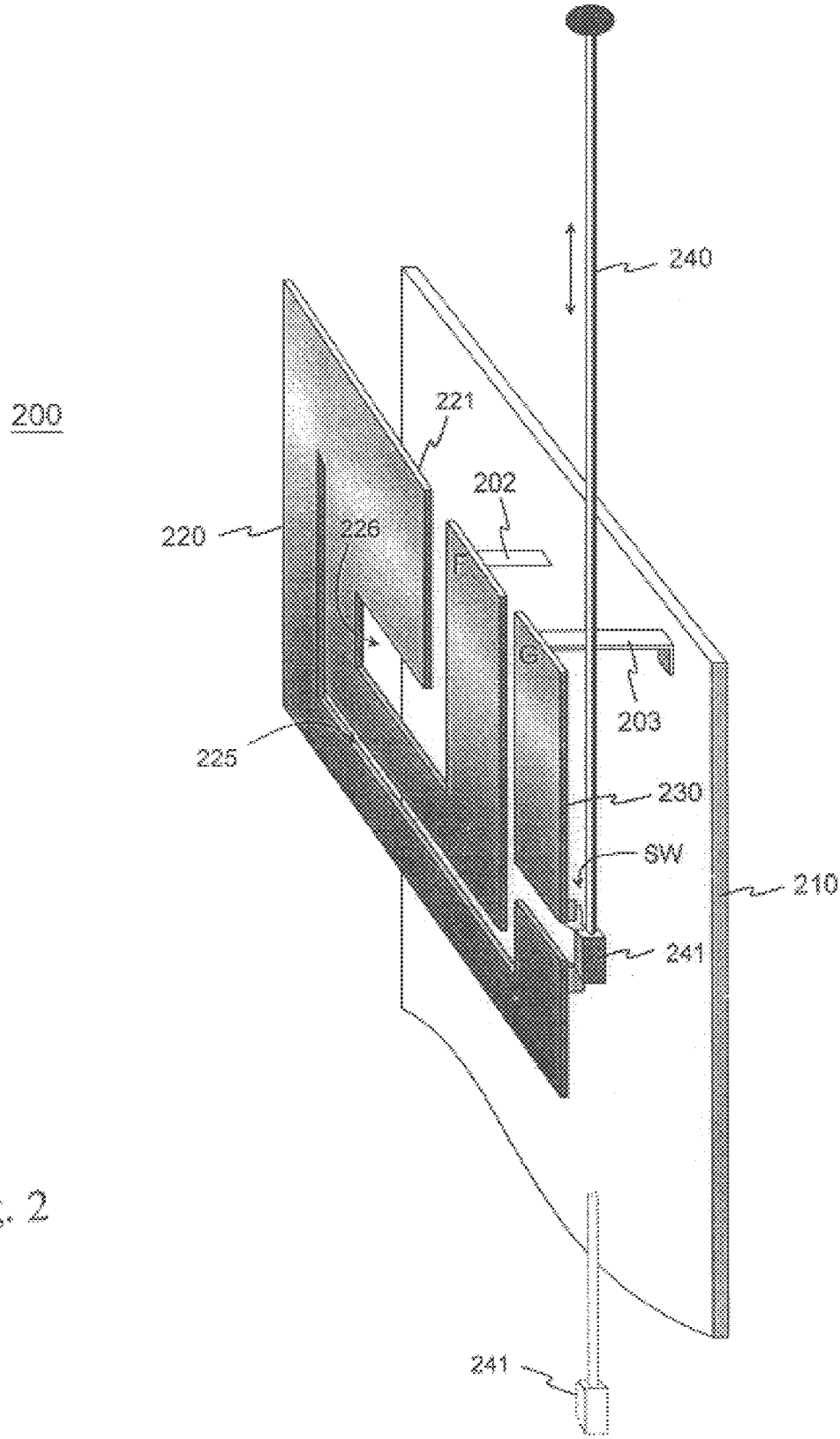
FIG. 2 shows an example of the antenna structure according to the invention.

FIG. 2 shows an example of the antenna structure according to the invention. The antenna structure 200 comprises a planar first element 220 and planar second element 230, whip element 240 and a switch SW. In this example, the antenna structure further comprises a ground plane 210. The first element 220 includes two slots 225 and 226 starting from the edge of the element so that the first element constitutes a conductive strip comprising two nested rings. The strip includes six rectangular corners so that when moving forward along the strip, the circling direction of the outer ring is opposite to that of the inner ring. In galvanic contact with the other end of the conductive strip at a point F there is the feed conductor 202 of the whole antenna structure. The second element 230 in the example depicted by FIG. 2 is a straight conductive strip on the same plane as the first element. At a point G in the other end, the upper end in FIG. 2, of the second element is joined a ground conductor 203, which connects the second element to the signal ground 210.

The outer end of the second element, as seen from the ground point G, and the outer end of the first element, as seen from the feed point F, are relatively close to each other. In the operating mode in which the whip element is retracted, i.e. in the lower position, the switch SW interconnects the above-mentioned ends which are close to each other so that the conductive strips constituting the first and second elements are connected in series in between the antenna feed line conductors 202 and 203. The basic resonance frequency of the internal antenna depends on the overall length of the conductor between the feed and ground points. In the exemplary structure of FIG. 2 there is an extension 221 towards the feed point in the inner ring of the first element after two corners, as seen from the feed point F. This and the ground plane 210 give the internal antenna a second, upper, operating band at a desired location. In general, the shape of the planar elements and their parts, their mutual electromagnetic coupling and distance from the ground plane determine the frequency characteristics of the internal antenna, such as the number of bands and the bandwidths.

The whip element 240 is movable along its axis. In the lower position it and its connecting part are isolated from all conductive structural elements and it has no significant coupling to the other parts of the antenna structure. In FIG. 2, the whip element is shown in its upper position, i.e. extended. In this position, the connecting part 241 at the lower end of the whip element holds the switch SW open so that the above-mentioned conductive strip of the planar antenna is cut off between the first and second elements, and the planar antenna alone cannot function as a radiator. Instead, the whip element functions as a radiator. It is in galvanic contact with the first element 220 through the connecting part 241 of the whip and the contact spring of the switch SW. This arrangement provides for both the feed and the impedance matching of the whip element. Together with the first element the whip element forms an entity that resonates at the operating frequency. The electrical length of the entity may be arranged to be e.g. a quarter of the wavelength or three quarters of the wavelength. In all cases the length of the whip element itself is selectable because the matching can be realized through dimensioning of the first element 220.

The "lower end" of a structural part means in this description and in the claims the outermost end in the push-in direction of the whip element and has nothing to do with the operating position of the device. Conversely, the "upper end" of a structural part refers to the end opposite to the lower end.

In the example of FIG. 2 the planar elements 220 and 230 are rigid conductive plates that can be attached to the ground plane 210 by means of a dielectric frame, for example. The elements may also be conductive areas on a surface of a printed circuit board or a ceramic, for instance.

Figure 3A:
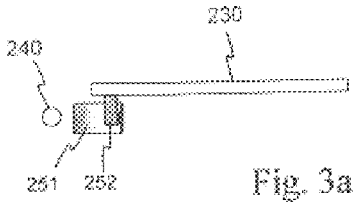
FIGS. 3*a–d* show an example of changing the operating mode in the antenna structure according to the invention.
Figure 3C:
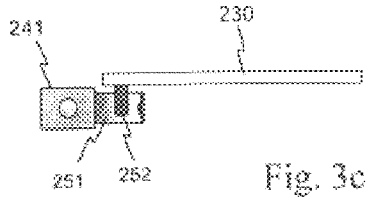
Figure 3B:
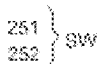
Figure 3B:
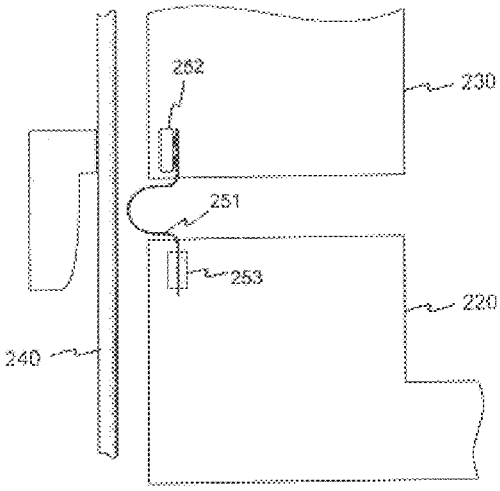
Figure 3D:
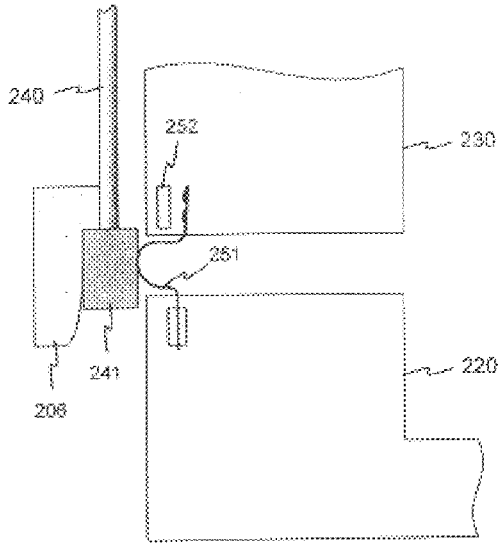

FIGS. 3*a–d* show an example of a switching function according to the invention for changing the operating mode of the antenna structure. FIGS. 3*a* and 3*b* illustrate a situation in which the whip element is retracted. In FIG. 3*a* the switch SW is viewed from above, and in FIG. 3*b* from between the planar elements and ground plane. The switch SW comprises a contact spring 251 and a counter contact 252. The contact spring 251 is attached by its lower end to a protrusion 253 in the first element 220. The counter contact 252 is a protrusion in the second element 230. The upper end of the contact spring exerts a spring force against the counter contact 252, producing a firm galvanic contact between the first and second elements. The whip element 240 lies beside the end of the rectangle defined by the first and second elements, isolated from the said elements and switch. FIGS. 3*c* and 3*d* illustrate a situation in which the whip element is extended. The connecting part 241 at the lower end of the whip element lies then between a dielectric supporting block 206 and the contact spring 251. This space is so narrow that the connecting part 241 pushes against the curve of the contact spring, thus disconnecting the upper end of the contact spring from the counter contact 252. The loop of the internal planar antenna is thus open but, on the other hand, the whip element is connected to the first element 220.

Figure 4:
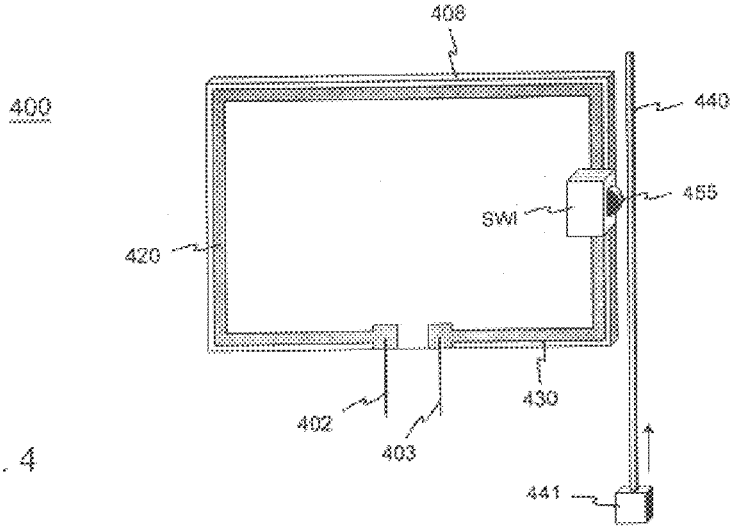
FIG. 4 shows another example of the antenna structure according to the invention.

FIG. 4 shows another example of the antenna structure according to the invention. The structure 400 comprises a printed circuit board 408, a first element 420, a second element 430, a whip element 440 and a switch SWI. The first and second elements are conductive strips on a surface of the printed circuit board 408 so that they form a rectangular loop antenna when the switch SWI puts them in galvanic contact with each other. In the example depicted, the feed point of the loop is located in the middle of the lower long side of the rectangle, to which point the feed line conductors 402 and 403 of the antenna structure are connected. Of these, feed conductor 402 is connected to the end of the first element 420 and the other conductor 403, which at another point is connected to the signal ground, is connected to the end of the second element 430. The switch SWI is a component at the edge of the printed circuit board 408, above one of the shorter sides of the loop antenna. When the whip element 440 is in the lower position according to FIG. 4 the loop antenna on the printed circuit board is complete. On the outer side of the switch component SWI there is a conductive contact stud 455 which can be pushed inside the switch component. When the whip element is extended the connecting part 441 at its lower end pushes against the contact stud 455 whereby the second element is disconnected from the first element and, instead, the whip element is connected in series with the first element. Thus the whip element is fed through the first element which at the same time functions as a matching element for the whip in accordance with the invention.

Figure 5:
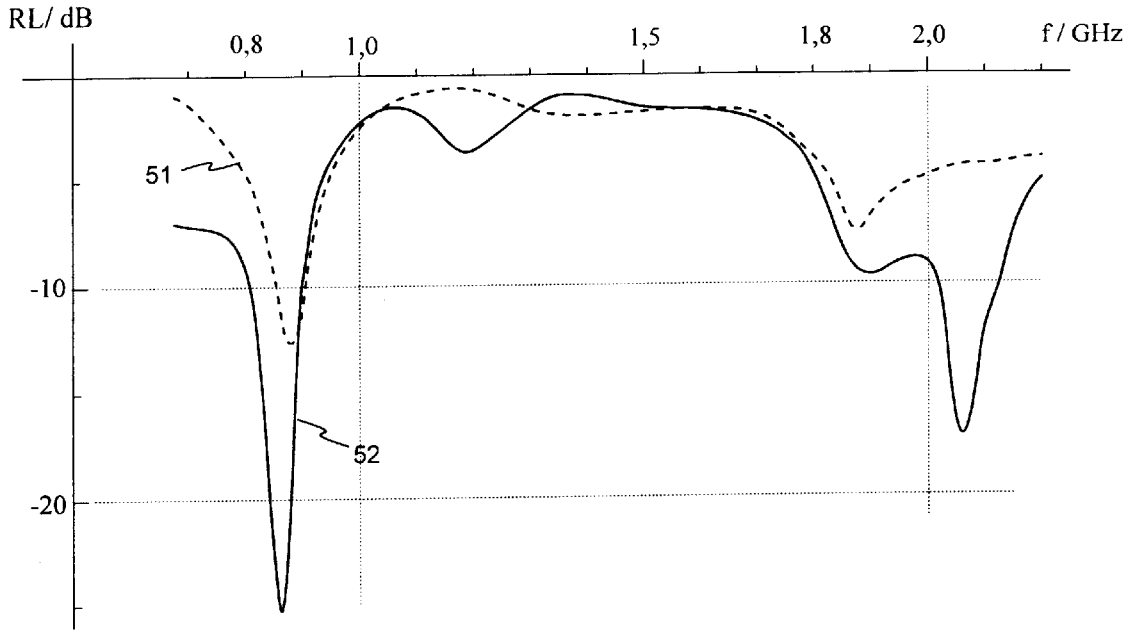
FIG. 5 shows an example of the frequency characteristics of an antenna according to the invention, FIGS. 6*a,b* show an example of a mobile station equipped with an antenna according to the invention.

FIG. 5 shows an example of the frequency characteristics of the antenna structure according to the invention. The figure shows two curves 51 and 52. Curve 51 represents the reflection losses RL of the antenna structure as a function of the frequency, when the whip element is retracted, and curve 52 represents the reflection losses when the whip element is extended. The smaller the reflection losses, i.e. the lower the curve, the more effective the antenna as regards radiation and reception. Both curves include two "dips" below −6 dB, which means the structure in question is designed to operate in two frequency bands. The lower operating band is in the area of 800 to 900 MHz and the upper operating band upwards of 1.8 GHz. Comparing the curves we can see that pulling out the whip element clearly improves the characteristics of the antenna structure in both operating bands. In a large part of the lower operating band, reflection losses are reduced by more than 10 dB. In the upper operating band both the bandwidth increases significantly and the reflection losses greatly reduce. The results shown are valid for a structure like the one depicted in FIG. 2.

Figure 6A:
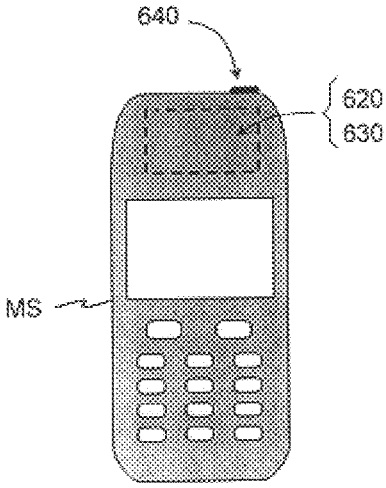
Figure 6B:
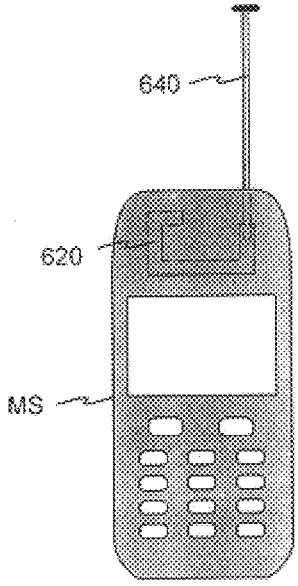

FIGS. 6*a* and *b* show a mobile station (MS) with an antenna structure according to the invention. The structure comprises an antenna 620, 630 located within the covering of the mobile station. In FIG. 6*a* the whip element 640 is pushed inside the covering of the mobile station, and in FIG. 6*b* it is pulled out from the covering. In the latter situation, the whip element has a coupling according to FIGS. 2 to 4 with the internal antenna element 620.

Above it was described some antenna structures according to the invention. The invention does not limit the shapes of the antenna elements and the implementation of the switch in the antenna to those particular structures. Neither does the invention limit the manufacturing method of the antenna nor the materials used in it. The inventional idea may be applied in different ways within the scope defined by the independent claim 1.

What is claimed is:

1. An antenna structure comprising a signal ground, an internal antenna of a radio apparatus and a whip element movable in relation to the internal antenna, wherein the internal antenna comprises a first element connected to a feed conductor of the antenna structure and a second element connected to the signal ground, the antenna structure further comprising a switch which, when the whip element is retracted inside the radio apparatus, galvanically interconnects the first and second elements and, when the whip element is extended, disconnects the first and second elements and galvanically connects the first element with the whip element to feed and to match the whip element.

2. An antenna structure according to claim 1, wherein the first and second elements are planar elements substantially on the same plane, said internal antenna then being a planar antenna.

3. An antenna structure according to claim 1, wherein said internal antenna is a loop antenna.

4. An antenna structure according to claim 1, wherein said switch comprises a contact spring attached in a fixed manner to the first element and a counter contact in the second element.

5. An antenna structure according to claim 1, wherein the extended whip element together with the first element is arranged to resonate substantially at least at one same frequency as the internal antenna.

6. An antenna structure according to claim 1, wherein the first and second elements are rigid conductive elements.

7. An antenna structure according to claim 1, wherein the first and second elements are conductive areas on a surface of a dielectric board.

8. A radio apparatus having an antenna structure which comprises a signal ground, an internal antenna of the radio apparatus and a whip element movable in relation to the internal antenna, wherein the internal antenna comprises a first element connected to a feed conductor of the antenna structure and a second element connected to the signal ground, the antenna structure further comprising a switch which, when the whip element is retracted inside the radio apparatus, galvanically interconnects the first and second elements and, when the whip element is extended, disconnects the first and second elements and galvanically connects the first element with the whip element to feed and to match the whip element.

* * * * *